US006658740B2

(12) United States Patent
Habben

(10) Patent No.: US 6,658,740 B2
(45) Date of Patent: Dec. 9, 2003

(54) BLADE ASSEMBLY FOR A VIBRATOR MOTOR

(75) Inventor: Rick L. Habben, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 70 days.

(21) Appl. No.: 09/809,872

(22) Filed: Mar. 16, 2001

(65) Prior Publication Data

US 2002/0129496 A1 Sep. 19, 2002

(51) Int. Cl.[7] ..... B26B 19/02
(52) U.S. Cl. ..... 30/223; 30/210; 30/216
(58) Field of Search ..... 30/210, 216, 223, 30/225

(56) References Cited

U.S. PATENT DOCUMENTS 1,567,110 A * 12/1925 Bristow ..... 30/223
1,746,989 A * 2/1930 Bristow ..... 30/225
2,174,130 A * 9/1939 Looper ..... 30/219
2,713,718 A * 7/1955 Hudson ..... 30/200
2,877,364 A 3/1959 Wahl et al.
2,986,662 A 5/1961 Wahl
3,026,430 A 3/1962 Wahl
5,819,415 A * 10/1998 Bruggers et al. ..... 30/223

* cited by examiner

*Primary Examiner*—Hwei-Siu Payer
(74) *Attorney, Agent, or Firm*—Greer, Burns & Crain, Ltd.

(57) ABSTRACT

A blade assembly for an electric hair cutter that includes a stationary blade and a cutting blade, where the cutting blade is configured for reciprocating arcuate motion relative to the stationary blade. The stationary blade includes a plurality of stationary cutting teeth, with each of the stationary cutting teeth having a tip at a distal end thereof, and wherein the tips of the stationary cutting teeth define a first imaginary line. The cutting blade includes a plurality of reciprocating cutting teeth, with each of the reciprocating cutting teeth having a tip at a distal end thereof, and wherein the tips of the reciprocating cutting teeth define a second imaginary line. The distance between the first imaginary line and the second imaginary line is greater near both end portions thereof than a corresponding distance at a center portion between the end portions.

16 Claims, 17 Drawing Sheets

BLADE ASSEMBLY FOR A VIBRATOR MOTOR

This invention relates to blade assemblies for vibrator motors, and more particularly to blade assemblies for hair clippers, and the like, that are configured to reduce the likelihood of nicking or cutting a subject's skin.

BACKGROUND OF THE INVENTION

Vibrator motors have been used in electric hair clippers for many years, as in U.S. Pat. Nos. 2,877,364, 2,986,662 and 3,026,430, which are hereby incorporated by reference in their entirety. One example of a conventional vibrator motor in a hair clipper is shown in FIG. 5. Of course, there are other types and models of hair clippers other than that shown in FIG. 5 that also include vibrator motors. Referring back to FIG. 5, this figure shows a hair clipper 10 that includes a case 12, a stationary hair cutting blade 14, and a reciprocating hair cutting blade 16. The blade 16 is driven by a vibrator motor 18, which includes a stationary coil 20, coil laminations 22 and moving laminations 24. It should be noted that in some models, a moving steel arm is utilized in place of the moving laminations 24.

The coil laminations 22 are stationary within the case 12. The moving laminations 24 are part of a vibrating arm 26. The vibrating arm 26 also includes a tail bracket 28. The arm 26 is operatively connected to the moving blade 16 through a resilient finger 32. A mechanical spring system 34 includes the tail bracket 28, which is fixed at one end to the case 12, and coil springs 36 located on each side of the tail bracket 28 and between adjacent walls of the case 12. The mechanical spring system 34 is designed so that the vibrating arm 26 has an appropriate resonant frequency.

In operation, the arm laminations 24 tend to reciprocate in a slight arc because the vibrating arm 26 is fixed at one end. As a result, the moving blade 16 tends to reciprocate along an elliptical path A. As will be explained below, the elliptical path of the moving blade 16 contributes to the problem addressed by the present invention.

While the conventional hair clippers just described have been useful and commercially successful, cutting or nicking a subject's skin can be a problem. Specifically, hair clippers are sometimes used to cut close to the scalp, with the tips of the blade teeth being placed directly against the scalp. However, due to the elliptical path of the cutting blade, there is a tendency for the cutting blade to extend beyond the stationary blade towards the end of the blade's stroke, resulting in cutting or nicking of a subject's skin. By manner of illustration, FIG. 6A is a front view of a conventional cutting assembly, and FIG. 6B is an enlarged fragmentary view of FIG. 6A showing the cutting blade 16 extending beyond the stationary blade 14 towards the end of the cutting stroke.

To address the above-described problem, in some conventional hair clippers, the length of the stationary blade 14 is increased with respect to the length of the moving blade in order to increase the size of an overlap, $X_{Gap}$ (shown toward the left of FIG. 6A), which is measured between the end of the cutting blade 16 and end of the stationary blade 14. Notably, if the overlap $X_{Gap}$ is sufficiently great, then the cutting blade 16 will not extend beyond the stationary blade 14 at the end of the cutting stroke. Unfortunately, in order to provide an extremely close cut, it is desirable to reduce $X_{Gap}$ to approximately zero.

Alternatively, some conventional hair clippers incorporate a blade guide into the device in order to ensure that the cutting blade travels in a straight line, without extending beyond the stationary blade. This approach provides satisfactory results, but results in higher manufacturing costs, making this approach unsuitable for low cost hair clippers. Moreover, the blade guide imposes a side load on the reciprocating blade, which undesirably reduces the cutting power in a vibrator type clipper.

Yet another approach to the above-described problem involves reducing the stroke of the cutting blade. As described above, the cutting blade is most likely to extend beyond the stationary blade at the extreme end of the stroke. Thus, the likelihood of the stationary blade extending beyond the stationary blade may be reduced by, for example, reducing the ampere-turns of the motor. However, reducing the stroke of the blade in this manner can also reduce cutting performance to an unacceptable level.

Thus, there is a need for a blade assembly for hair clippers which provides an extremely close cut while avoiding pinching or nicking of the skin. There is also a need for blade assemblies which are inexpensive to manufacture, and which avoid the use of rigid guide paths. Another need is for an improved blade assembly for vibrator hair clippers, where the improved blade assembly can be easily incorporated in existing product designs.

Accordingly, one object of this invention is to provide new and improved blade assemblies for vibratory hair clippers.

Another object is to provide new and improved blade assemblies which provide a close cut without the use of a rigid blade guide.

Yet another object is to provide new and improved blade assemblies which provide a close cut without sacrificing cutting power.

Still another object is to provide new and improved blade assemblies which are simple to make and assemble, and which can be easily adapted for use in conventional vibrator hair clippers.

SUMMARY OF THE INVENTION

Briefly, the present invention relates, in part, to a blade assembly for an electric hair cutter, where the blade assembly includes a stationary blade and a cutting blade. The stationary blade includes a plurality of stationary cutting teeth, with each of the stationary cutting teeth having a tip at a distal end thereof, and wherein the tips of the stationary cutting teeth define a first imaginary line. The cutting blade is configured for reciprocating arcuate motion relative to the stationary blade, and has a plurality of reciprocating cutting teeth, with each of the reciprocating cutting teeth having a tip at a distal end thereof. The tips of the reciprocating cutting teeth define a second imaginary line. One important feature of the present invention is that the distance between the first imaginary line and the second imaginary line is greater near both end portions thereof than a corresponding distance at a center portion between the end portions.

The increased distance near the end portions may be realized in any of several different ways. For example, the tip heights of the reciprocating cutting teeth may gradually increase from each of the first and second ends toward the midpoint, whereby the tooth tips define the second imaginary line in the form of an arc. Alternatively, the tip heights of the reciprocating cutting teeth near both the first and second ends only may be shorter than the tip heights of the reciprocating cutting teeth near the midpoint, such that a group of the reciprocating cutting teeth near the midpoint are all of a uniform tip height.

According to another embodiment of the present invention, the cutting teeth height configurations of the stationary blade and the cutting blade are transposed. Specifically, tip heights of the stationary cutting teeth proximate one of the first and second ends are longer than the tip heights of the cutting teeth proximate a midpoint between the first and second ends. In this embodiment, the first imaginary line is thus preferably in the form of a generally concave arc, either with or without a straight center portion.

As a further alternative, both the first and the second imaginary lines may be configured so that neither line is a generally straight line. Preferably, the first imaginary line is generally concave and the second imaginary line is generally convex. Optionally, either one of, or both, the first imaginary line and the second imaginary line may also include a straight portion near the center thereof.

Each of the above described embodiments provides a closer cut than possible with traditional hair clipper blades, without sacrificing cutting power or increasing the cost of manufacture.

BRIEF DESCRIPTION OF THE DRAWINGS

The above-mentioned and other features of this invention and the manner of obtaining them will become more apparent, and the invention itself will be best understood by reference to the following description of several embodiments of the invention taken in conjunction with the accompanying drawings in which:

FIG. 1C' is a variation on the embodiment shown in FIG. 1C;

FIG. 2C' is a variation on the embodiment shown in FIG. 2C;

FIG. 3C' is a variation on the embodiment shown in FIG. 3C;

DETAILED DESCRIPTION OF THE EMBODIMENTS

The inventor of the present invention has discovered that it is possible to provide a closer cut than possible with a conventional cutting blade assembly, while still maintaining a low likelihood of undesirably nicking the subject's skin, by selectively increasing the gap between the reciprocating teeth and the stationary teeth.

Figure 5:
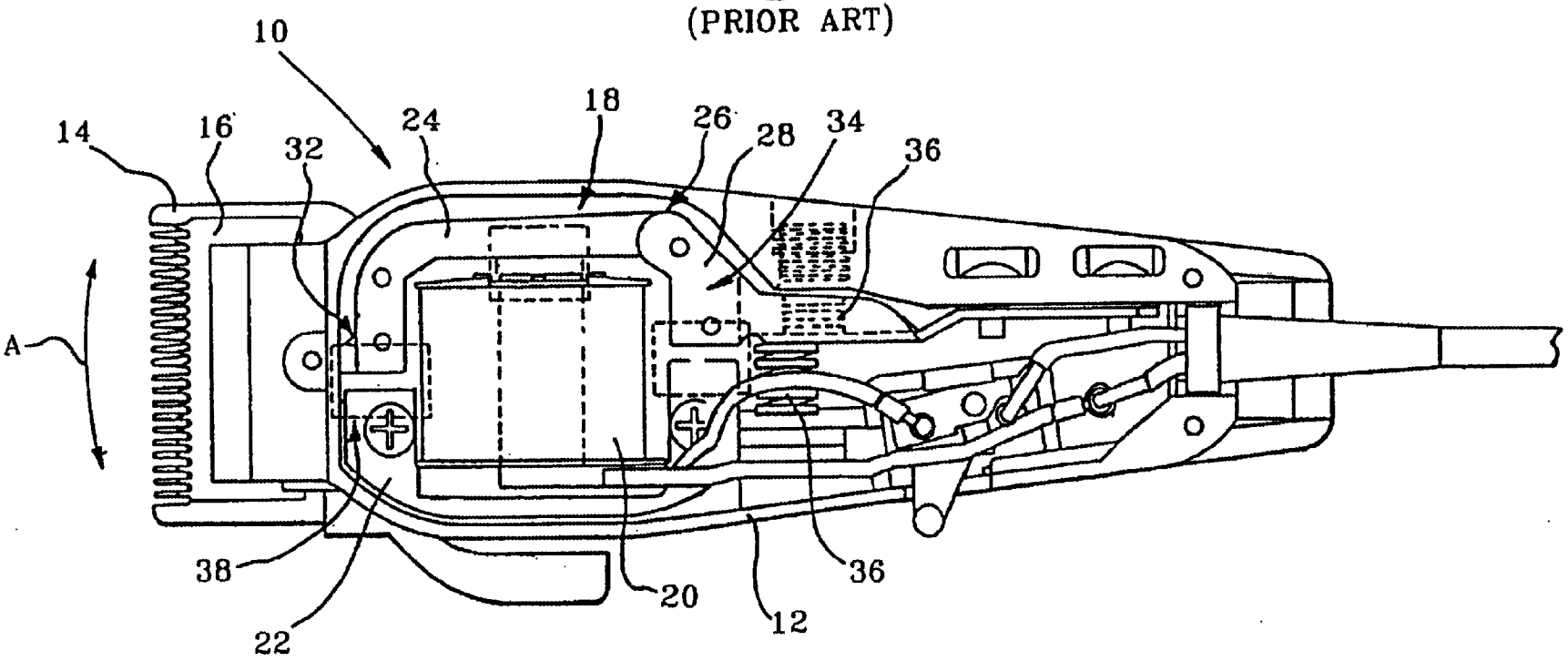
Fig. 5 (PRIOR ART)
FIG. 5 is a sectional view of a conventional hair cutter assembly.
Figure 6A:
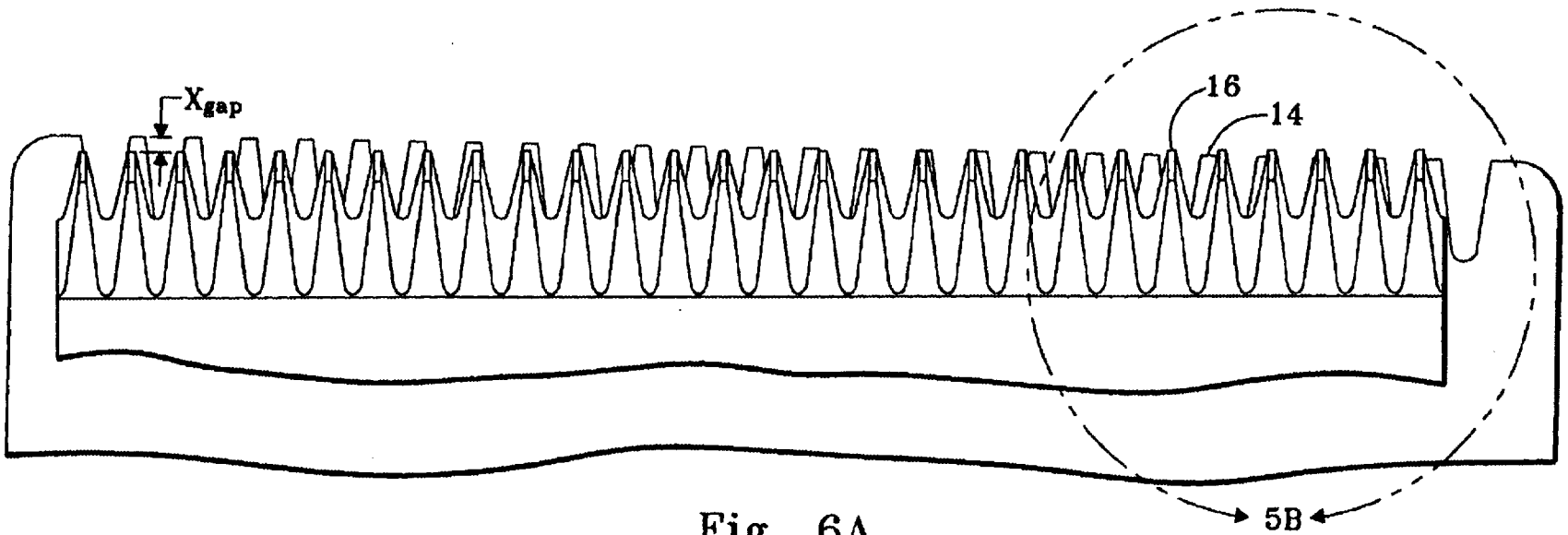
Fig. 6A (PRIOR ART)
FIG. 6A is front view of a conventional cutting assembly.
Figure 6B:
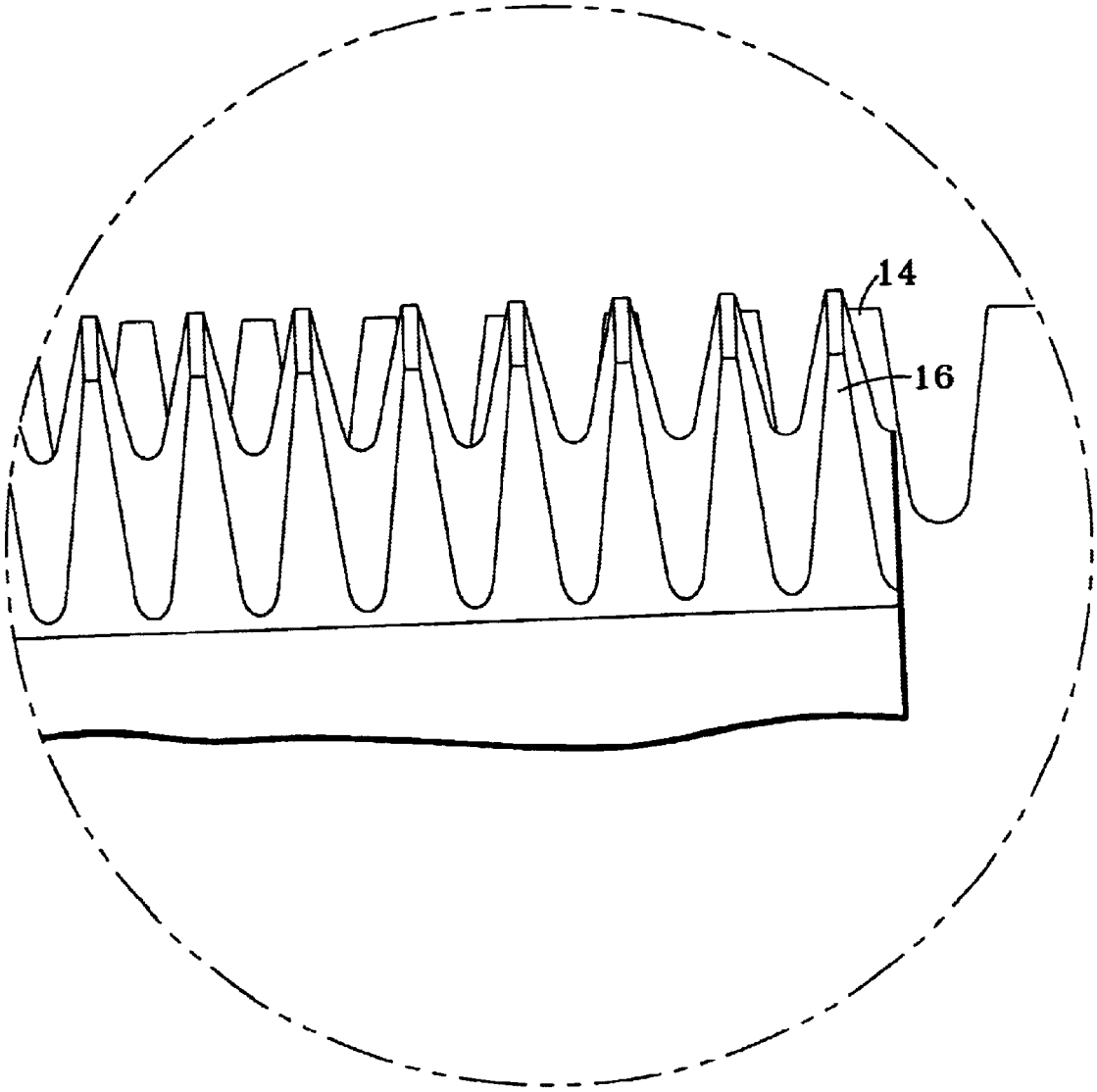
Fig. 6B (PRIOR ART)
FIG. 6B is an enlarged fragmentary view of FIG. 6A showing the cutting blade extending beyond the stationary blade at the end of the cutting stroke.

A blade assembly 100 (FIGS. 1A–3D) of the present invention is configured for use with a conventional hair clipper. For illustrative purposes, the present blade assembly 100 will be described for use with the conventional hair clipper 10 shown in FIG. 5. However, it should be understood that the present invention is not limited to being used with hair clippers of the type depicted in FIG. 5, but instead may be adapted for use with many different types of hair clippers.

The blade assembly 100 includes a reciprocating blade 102 and a stationary blade 104. More particularly, the blade assembly 100 of the present invention is specifically configured for use with a hair clipper which drives the cutting blade along a slightly elliptical path.

The blades 102 and 104 have rows of teeth 106 and 108, respectively, which are arranged so that hair which enters between adjacent teeth 106 is cut as the teeth 106 move back and forth across the teeth 108. As best seen in FIG. 1E, teeth 106 and 108 are generally composed of a root portion $\mathbf{106}_{root}$, $\mathbf{108}_{root}$ and a cutting face portion $\mathbf{106}_{face}$, $\mathbf{108}_{face}$. As known to those of ordinary skill in the art, the majority of the cutting action takes place where the face portion of the reciprocating blade crosses the face portion of the stationary blade.

As described in the background of the invention, achieving an extremely close cut requires a reduction in the overlap $X_{Gap}$ between the cutting blade and the stationary blade. However, once the overlap is reduced below a threshold level, there is an increased likelihood of cutting or nicking a subject's skin.

Figure 1A:
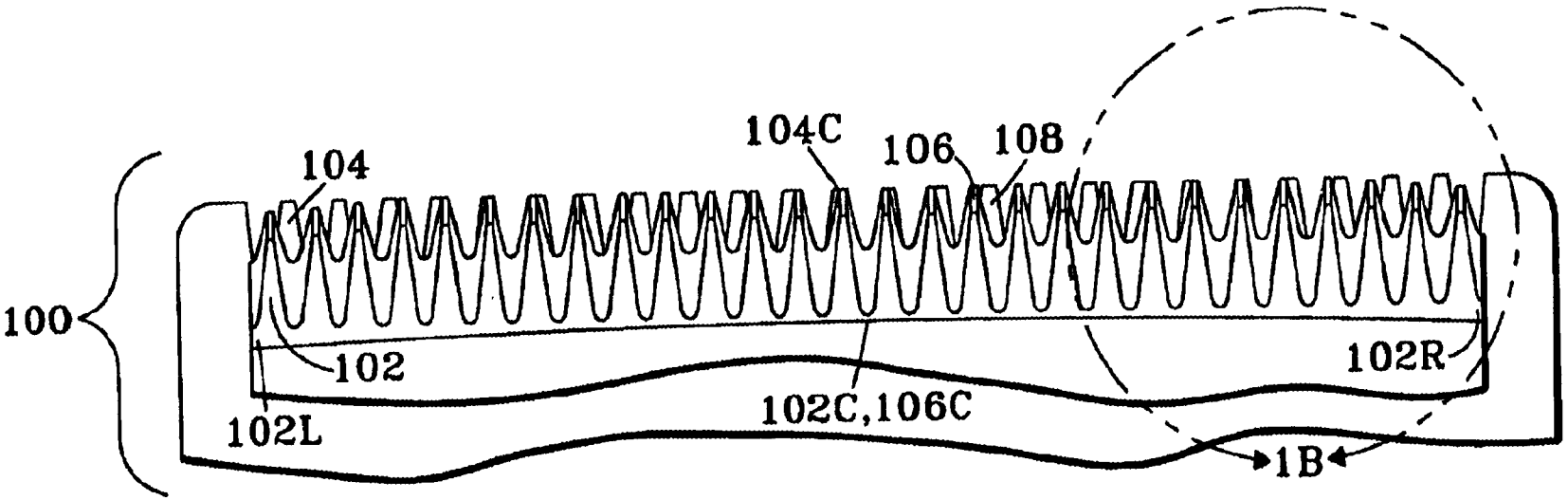
FIG. 1A is a first embodiment of a clipper blade assembly of the present invention in an initial state.

FIG. 1A illustrates a first embodiment of the clipper blade assembly 100 of the present invention in an initial state in which a midpoint 102C of the reciprocating cutting blade 102 is aligned with a midpoint 104C of the stationary cutting blade 104.

Figure 1B:
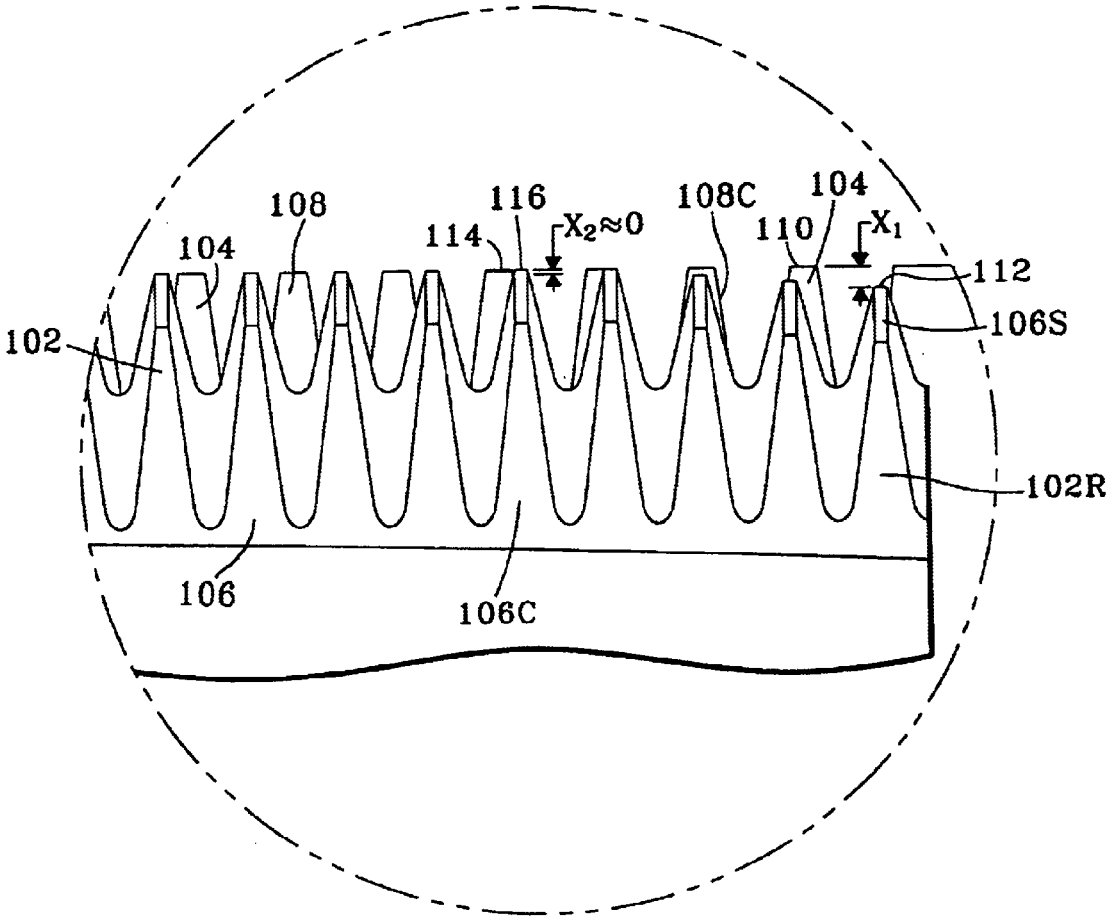
FIG. 1B is an enlarged fragmentary view of FIG. 1A in an initial state.

FIG. 1B is an enlarged fragmentary view of a rightmost portion of FIG. 1A, showing that selected reciprocating cutting teeth 106S, located at the proximate end 102R of the reciprocating cutting blade 102, are formed with tips that are shorter than cutting teeth 106C, which are located proximate the midpoint 102C. In contrast, the teeth 108 of the stationary blade 104 each have a uniform tip height. This aspect of the invention is further illustrated in FIG. 1C, which shows the overall shape of the reciprocating cutting blade 102 and the overall shape of the stationary cutting blade 104.

Figure 1C:
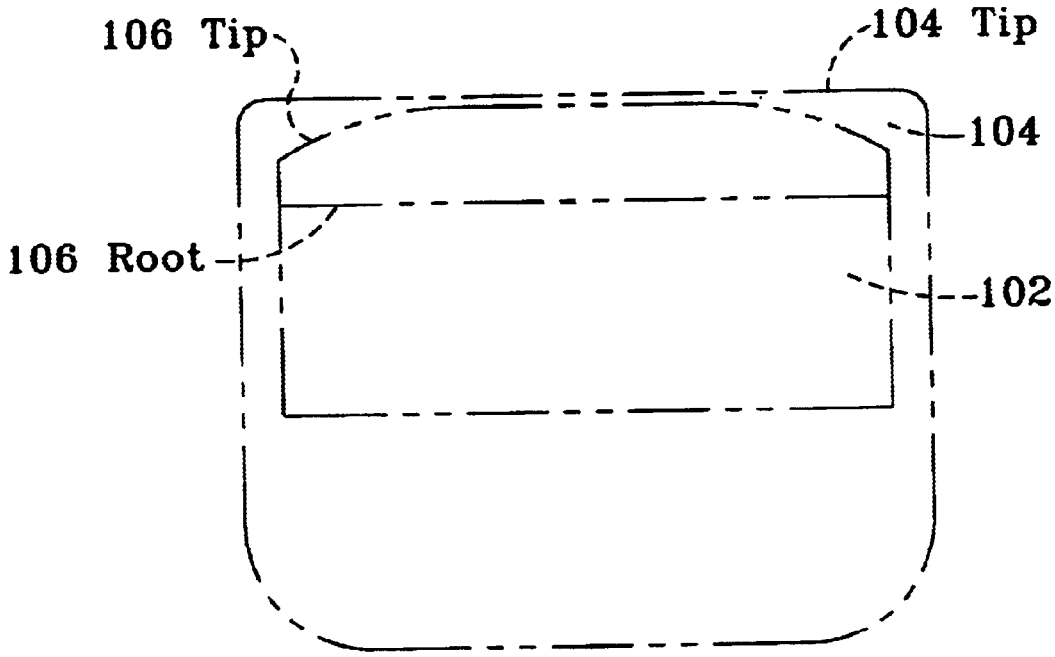
FIG. 1C is an overhead plan view of the clipper blade assembly of FIG. 1A.
Figure 1C:
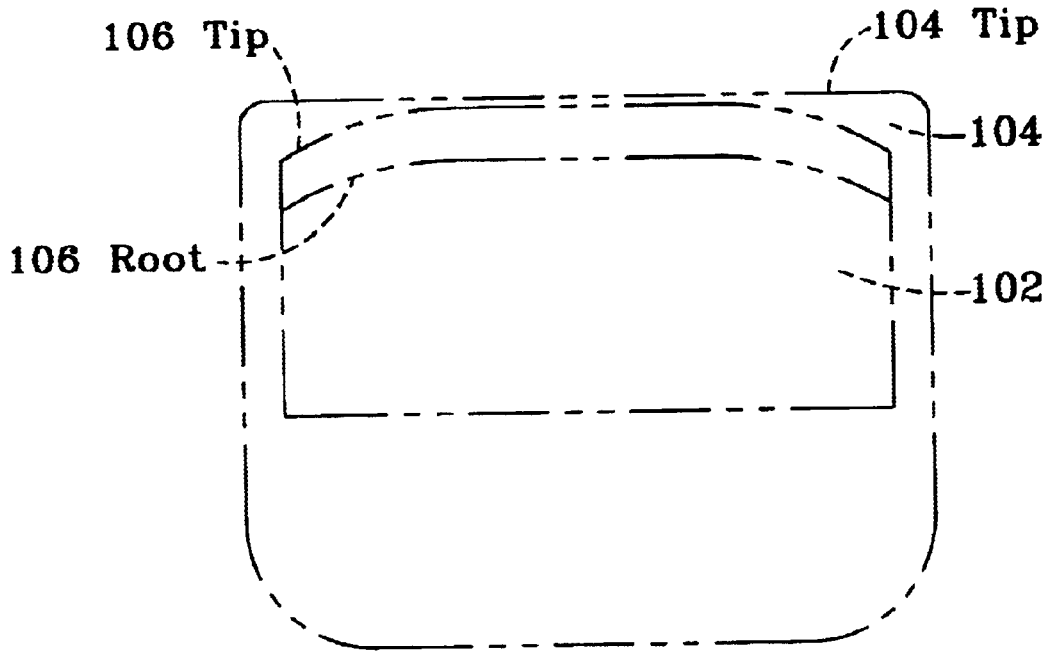

Reducing the tip heights of the outer teeth may be accomplished in a variety of different ways. For example, FIG. 1C shows an embodiment where the tip heights of the outer teeth have been shortened, and an imaginary tip line $\mathbf{106}_{Tip}$ (created by drawing a line connecting together the tips of the reciprocating blade 102) is defined. As can be seen in FIG. 1C, line $106_{Tip}$ includes curved portions at the right and left ends thereof, and a straight portion connecting the two curved portions. Thus, the tip heights gradually increase from the short tip heights at the right and left ends until reaching the center portion, at which point all of the tip heights are the same. As a slight variation on the FIG. 1C embodiment, it is contemplated that two straight inclined lines (not shown) may be substituted for the two curved portions on the right and left ends.

While the tip height is varied as discussed above, one of ordinary skill in the art will also appreciate that there are several approaches of varying the tooth height of a tooth, which is defined as the distance between the tip and the root of the tooth. One approach is to lower the position of the tip, such as depicted by the far left and right edges of $106_{tip}$ of FIG. 1C, while maintaining the roots of each tooth along a straight line, such as shown by $106_{root}$. In the FIG. 1C embodiment, the tooth heights of the leftmost and the rightmost teeth are shorter than the tooth heights of the center teeth, which each have tips that are aligned along an imaginary straight line.

FIG. 1C' shows an example of an embodiment in which the tooth heights are constant, and only the tip heights of the outer right and left teeth are shortened. In this figure, both the tips ($106_{Tip}$) and the roots ($106_{root}$) are varied in the same manner, and accordingly the imaginary tip line and the imaginary root line are parallel. However, it should be noted that the relative tip heights of the leftmost and the rightmost teeth are shorter than the tip heights of the center teeth. Yet another approach is to vary the positions of both the imaginary root line and the imaginary tip line (not illustrated in the drawings).

Referring back to FIG. 1B, this figure shows that the stationary cutting teeth 108 cooperatively define a first overlap $X_1$ with the relatively shorter reciprocating cutting teeth 106S. The overlap $X_1$ is measured from a tip end portion 110 of tooth 108 to a tip end portion 112 of the tooth 106S. Similarly, the stationary cutting teeth 108C cooperatively define a second overlap $X_2$ with the tooth 106C. The overlap $X_2$ is measured from a tip end portion 114 of tooth 108 to an end 116 of the tooth 106C. Notably, the overlap $X_1$ is greater than the overlap $X_2$, and preferably $X_2$ is approximately zero.

In one preferred embodiment, the overlap $X_1$ is approximately between 10 and 15 thousandths of an inch, although other dimensions are also contemplated as being within the scope of the invention. Moreover, depending on the pivot point of the reciprocating blade 102, the maximum overlap at the rightmost stroke position (FIG. 1B) of the reciprocating blade 102 may be different from the maximum overlap at a leftmost stroke position of the reciprocating blade 102 (not illustrated).

Figure 1D:
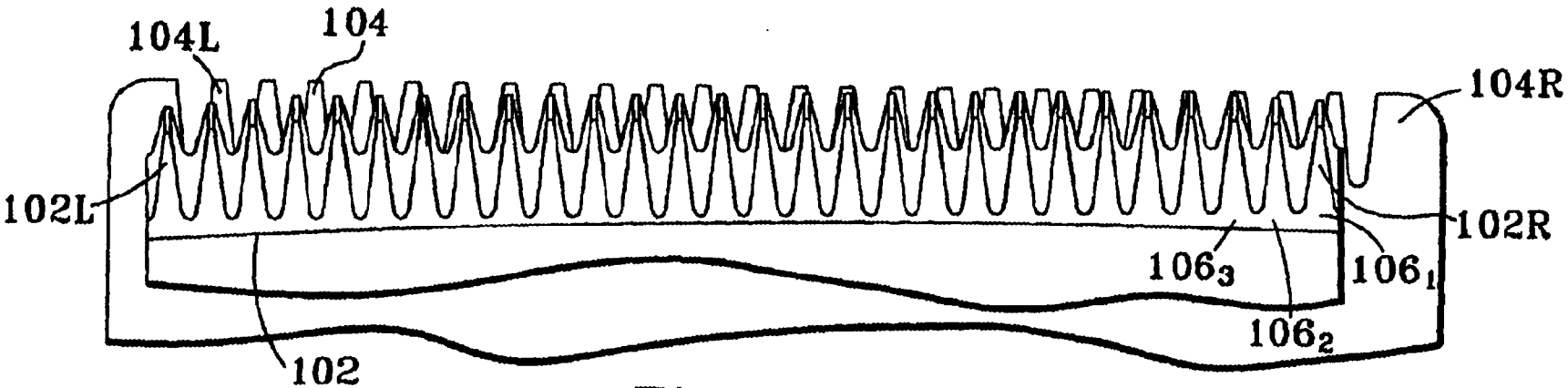
FIG. 1D shows the clipper blade assembly of FIG. 1A towards the end of a cutting stroke.
Figure 1E:
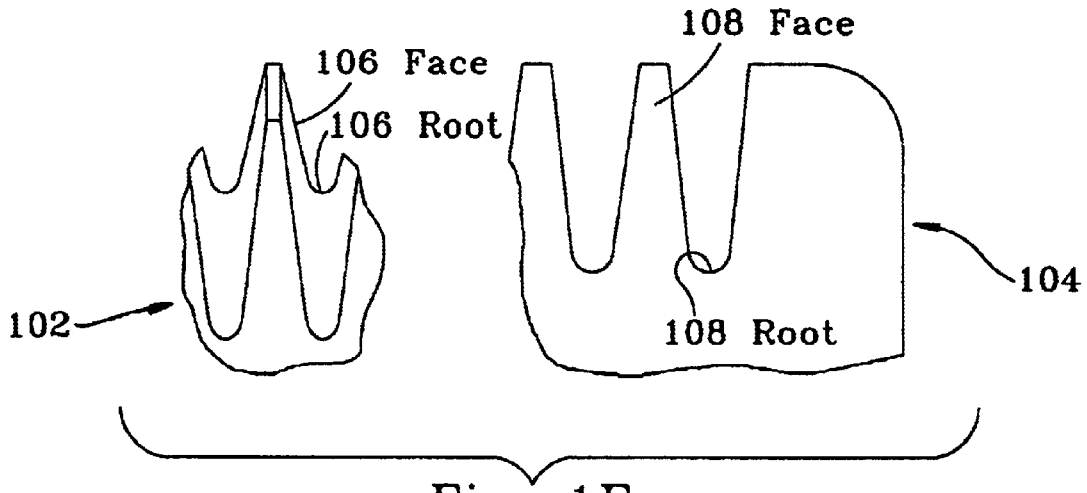
FIG. 1E is a drawing of partial sectional views of a tooth of the stationary blade and a tooth of the reciprocating blade.

FIG. 1D shows the cutting assembly 100 towards the end of a cutting stroke in which end 102R of the reciprocating cutting blade 102 is at a leftmost position. It should be noted that even in this extreme leftmost position, the tips of the reciprocating teeth on blade 102 are not higher than the tips of the teeth on the stationary blade 104.

One of ordinary skill in the art will readily appreciate that the cutting assembly of this embodiment provides an extremely close cut, as the majority of the teeth 106 have the minimal overlap $X_2$ with the teeth 108, since very few of the teeth 106S have the larger overlap $X_1$ (where $X_1$ and $X_2$ are shown in FIG. 1B).

Figure 2A:
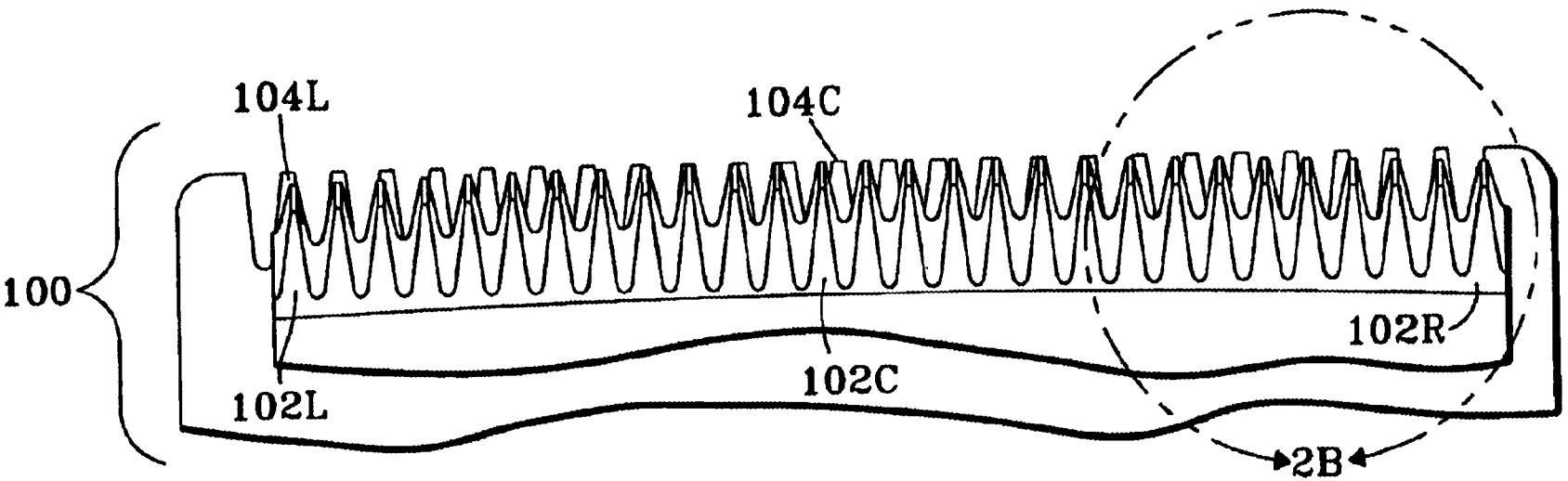
FIG. 2A is a second embodiment of a clipper blade assembly of the present invention in an initial state.

FIG. 2A illustrates a second embodiment of clipper blade assembly 100 in an initial state in which a midpoint 102C of the reciprocating cutting blade 102 is substantially aligned with the midpoint 104C of the stationary cutting blade 104.

Figure 2B:
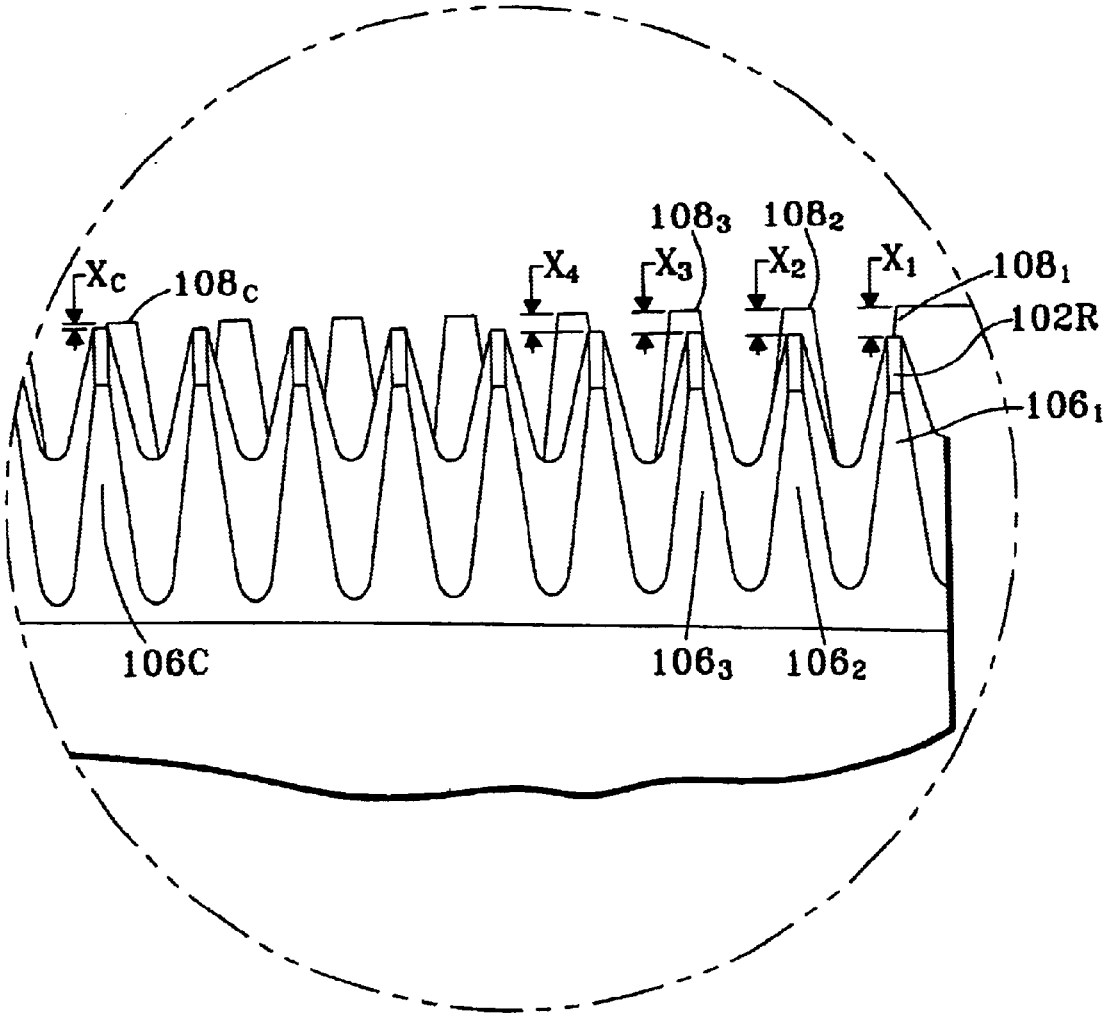
FIG. 2B is an enlarged fragmentary view of FIG. 2A.

FIG. 2B is an enlarged fragmentary view of the FIG. 2A, showing that a tip height of the reciprocating cutting teeth 106 gradually increases from a shortest height proximate end 102R (and end 102L) of the reciprocating cutting blade 102, reaching a maximum tip height proximate the midpoint 102C. Again, in this embodiment also, the teeth 108 of the stationary blade 104 have a uniform tip height. This aspect of the invention is further illustrated in FIG. 2C which shows the overall shape of the reciprocating cutting blade 102 and the overall shape of the stationary cutting blade 104.

Figure 2C:
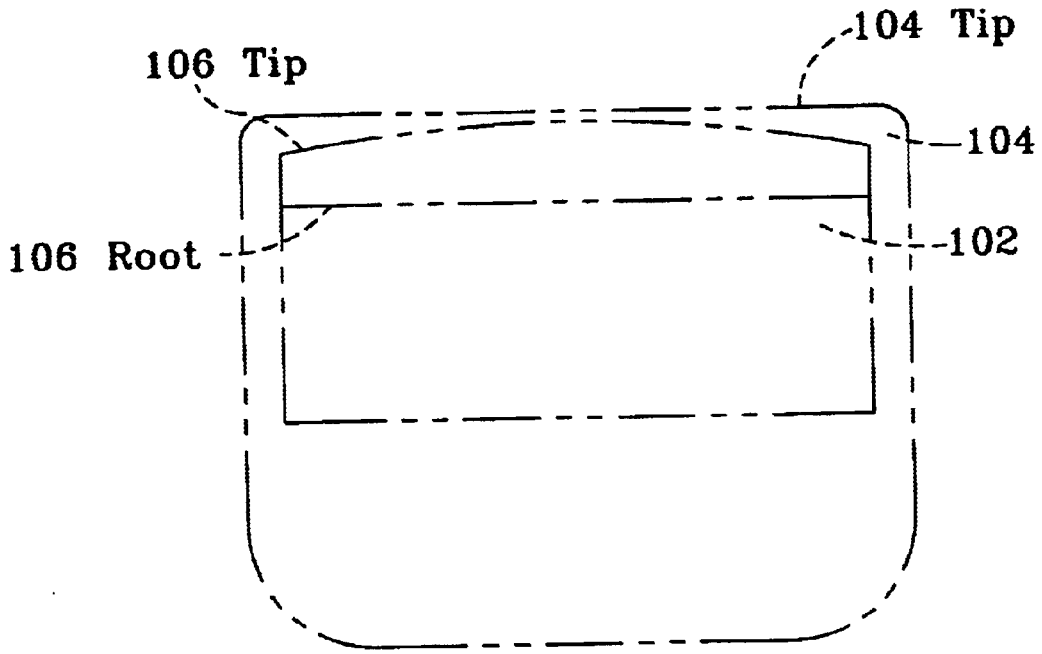
FIG. 2C is an overhead plan view of the clipper blade assembly of FIG. 2A.
Figure 2C:
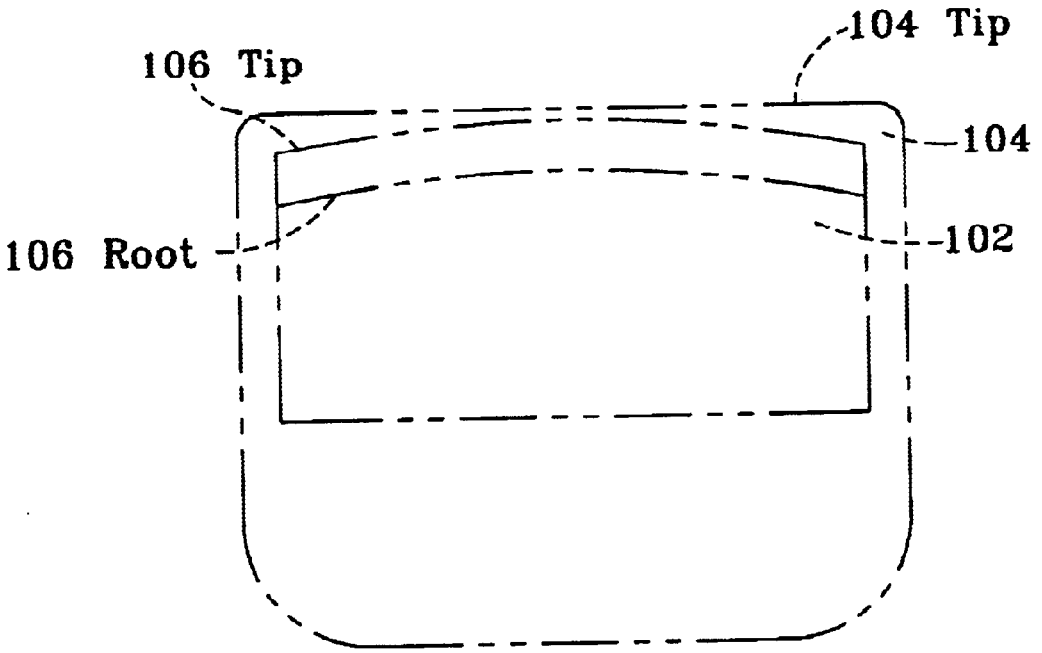

As described above, the graduated tip heights of the teeth may be achieved by varying the tip positions while either maintaining the root positions along a straight line or by varying the root positions. Thus, for example, FIG. 2C illustrates that the graduated height of the teeth is achieved by varying the tip positions $106_{Tip}$, while maintaining a uniform root position $106_{Root}$, and FIG. 2C' shows an alternate method for varying the tip heights of the teeth (similar to FIG. 1C'). In FIG. 2C', the tips $106_{Tip}$ of the teeth are aligned along an imaginary curved line, as in FIG. 2C, but the roots $106_{Root}$ are different from those of FIG. 2C. In the FIG. 2C' embodiment, the imaginary root line $106_{Root}$ is curved in the same manner as the imaginary tip line $106_{Tip}$, while in FIG. 2C, the imaginary root line $106_{Root}$ is a straight line. Thus, in the FIG. 2C' embodiment, although the tip heights are shorter near the right and left ends, the tooth heights are all equal because line $106_{Tip}$ is approximately parallel with line $106_{Root}$. It should be noted that the tip lines ($106_{Tip}$) of FIGS. 2C and 2C' are essentially both the same, and the tip lines of FIGS. 1C and 1C' are essentially both the same, but the tip lines of FIGS. 2C and 2C' differ from those of FIGS. 1C and 1C'. Specifically, the tip lines in FIGS. 2C and 2C' are curved along their entire lengths while the tip lines in FIGS. 1C and 1C' each include a straight line portion in the center.

Referring back to FIG. 2B, the stationary cutting teeth $108_1$, $108_2$, $108_3$ . . . $108_C$ cooperatively define a continuously varying overlap $X_1$, $X_2$, $X_3$ . . . $X_C$ with the reciprocating cutting teeth $106_1$, $106_2$, $106_3$ . . . $106_C$. Notably, the maximum overlap, $X_1$, is defined by cutting teeth $106_1$, which are located at proximate ends 102L and 102R, and the overlap gradually decreases until reaching the minimum overlap $X_C$, defined by cutting teeth $106_C$, which are proximate the midpoint 102C.

Figure 2D:
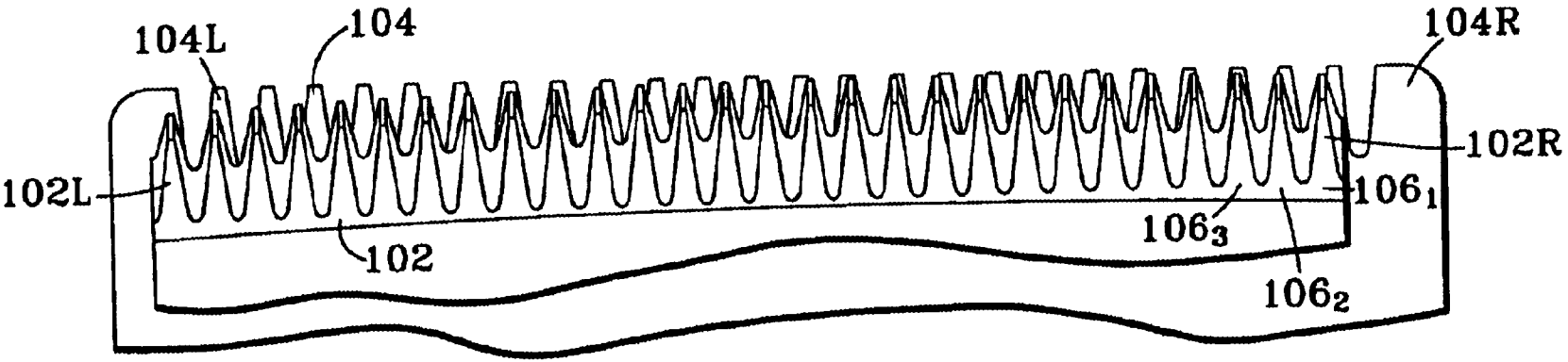
FIG. 2D shows the clipper blade assembly of FIG. 2A towards the end of a cutting stroke.

FIG. 2D shows the cutting assembly 100 towards the end of a cutting stroke, i.e., with reciprocating blade 102 in its leftmost position. In particular, FIG. 2D shows that the teeth of the reciprocating blade 102 do not extend beyond the teeth on the stationary blade 104 at the end of the cutting stroke.

Figure 3A:
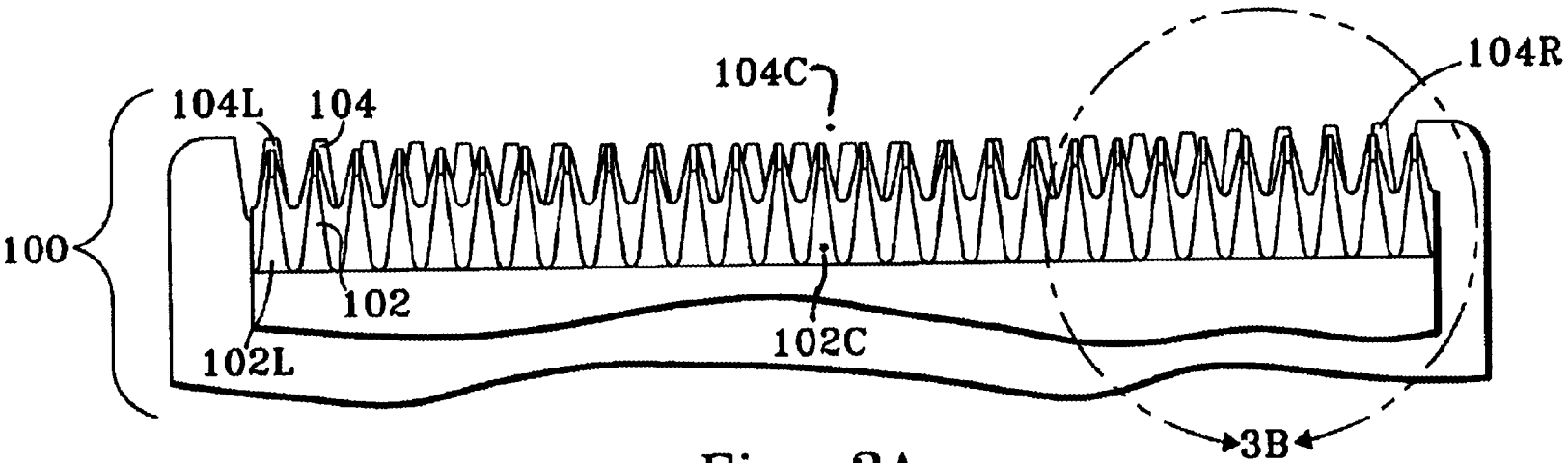
FIG. 3A is a third embodiment of a clipper blade assembly of the present invention in an initial state.

FIG. 3A illustrates a third embodiment of clipper blade assembly 100 in an initial state in which a midpoint 102C of the reciprocating cutting blade 102 is aligned with the midpoint 104C of the stationary cutting blade 104.

Figure 3B:
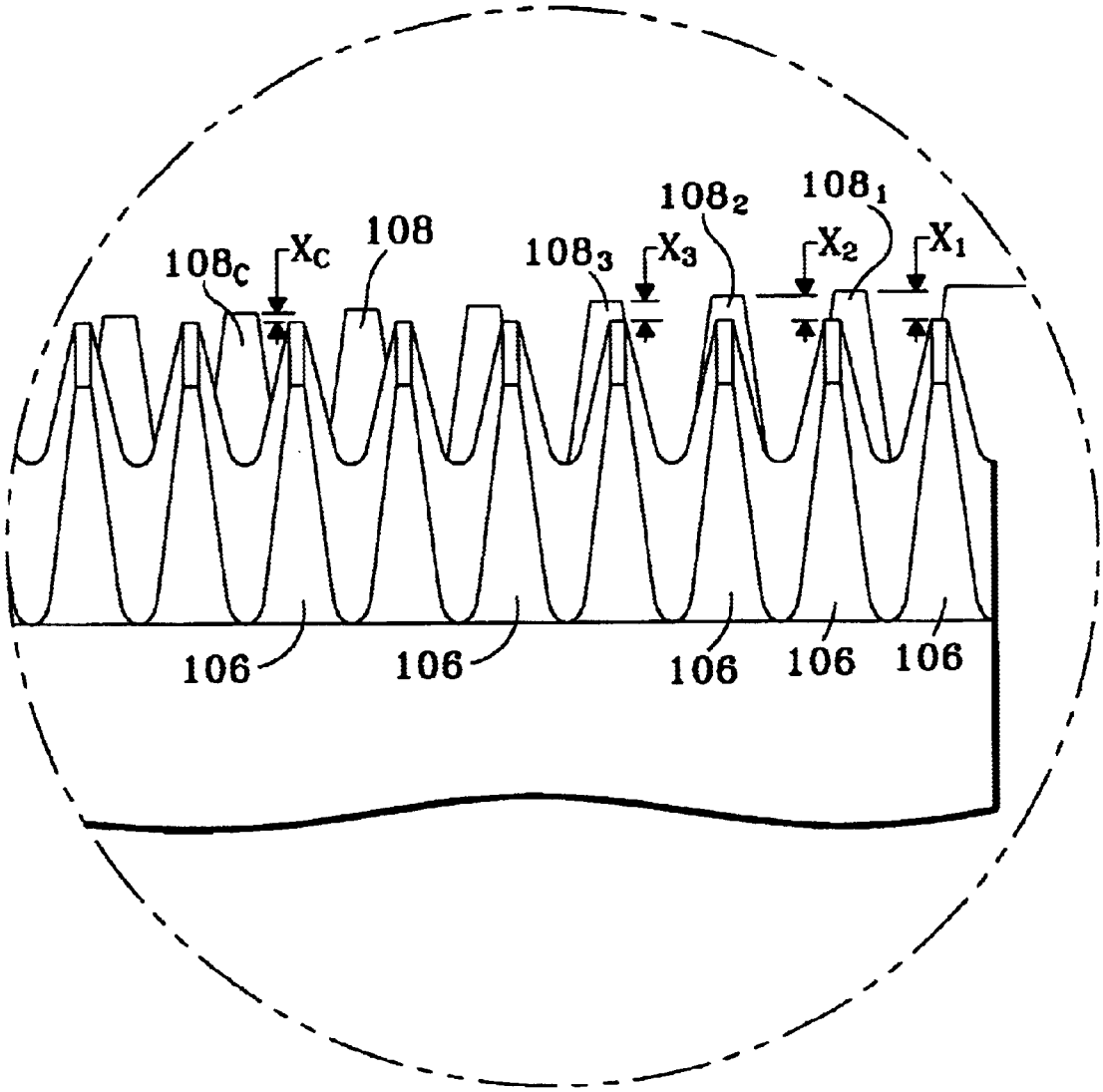
FIG. 3B is an enlarged fragmentary view of FIG. 3A.
Figure 3C:
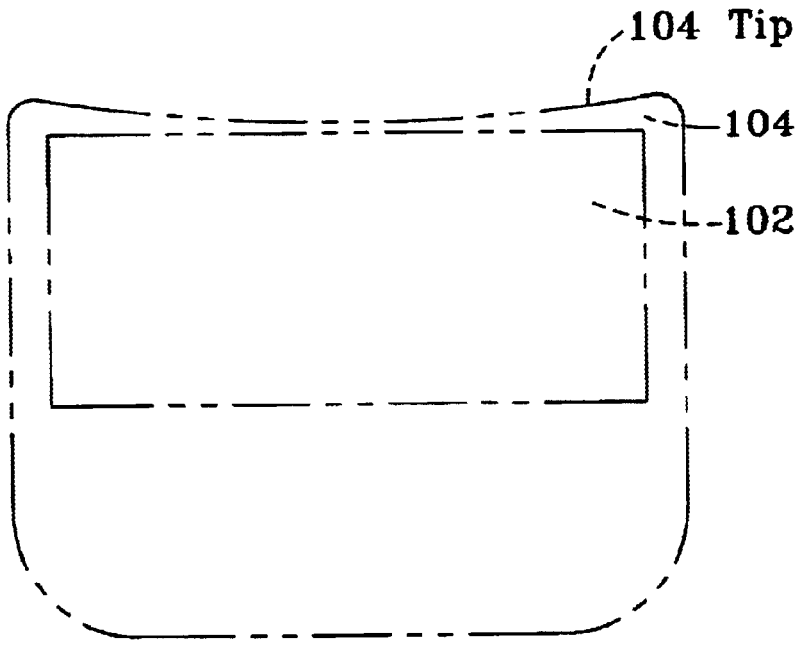
FIG. 3C is an overhead plan view of the clipper blade assembly of FIG. 3A.
Figure 3C:
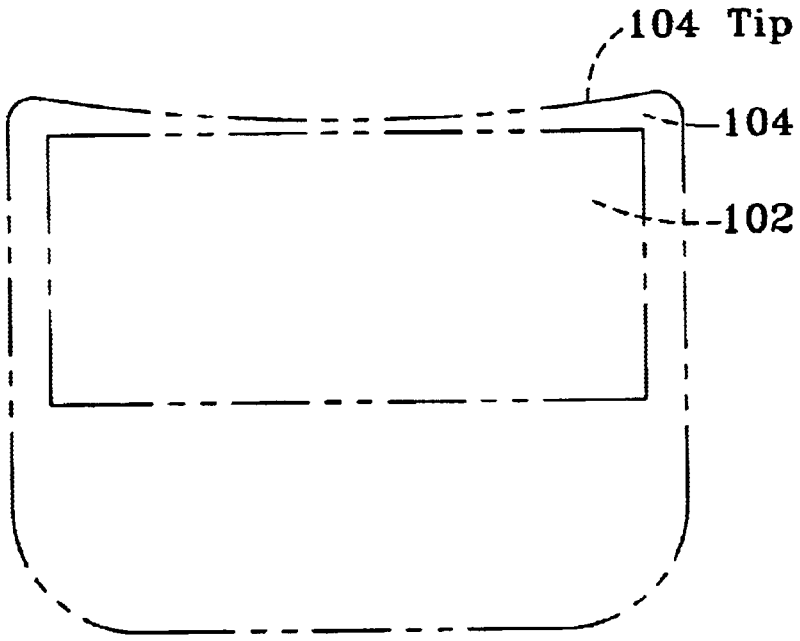

FIG. 3B is an enlarged fragmentary view of the FIG. 3A. FIGS. 3A and 3B together show that the height of the stationary cutting teeth 108 gradually increases from a shortest height proximate the midpoint 104C of the stationary cutting blade 104 to a maximum height at proximate ends 104L and 104R. In contrast, the teeth 106 of the reciprocating cutting blade 102 have a uniform tip height. This aspect of the invention is further illustrated in FIG. 3C, which shows the overall shape of the reciprocating cutting blade 102 and the overall shape of the stationary cutting blade 104. FIG. 3C' shows a variation of FIG. 3C. In FIG. 3C', the stationary blade 104 includes a center portion where the tips are all of a uniform height (defining a straight line), whereas in FIG. 3C, the tips at the center portion are of varying heights to define a concave curve along the entire length of an imaginary line created by the tip heights.

Referring back to FIG. 3B, one can see that the stationary cutting teeth $\mathbf{108}_1$, $\mathbf{108}_2$, $\mathbf{108}_3$ . . . $\mathbf{108}_C$ cooperatively define a continuously varying overlap $X_1$, $X_2$, $X_3$ . . . $X_C$ with the reciprocating cutting teeth 106, which are of a uniform height. Notably, the maximum overlap, $X_1$, is defined by cutting teeth $\mathbf{108}_1$, which are located at proximate ends 104L and 104R (FIG. 3A), and the overlap gradually decreases until reaching the minimum overlap $X_C$ defined by cutting teeth $\mathbf{108}_C$ proximate the midpoint 104C (FIG. 3A).

Figure 3D:
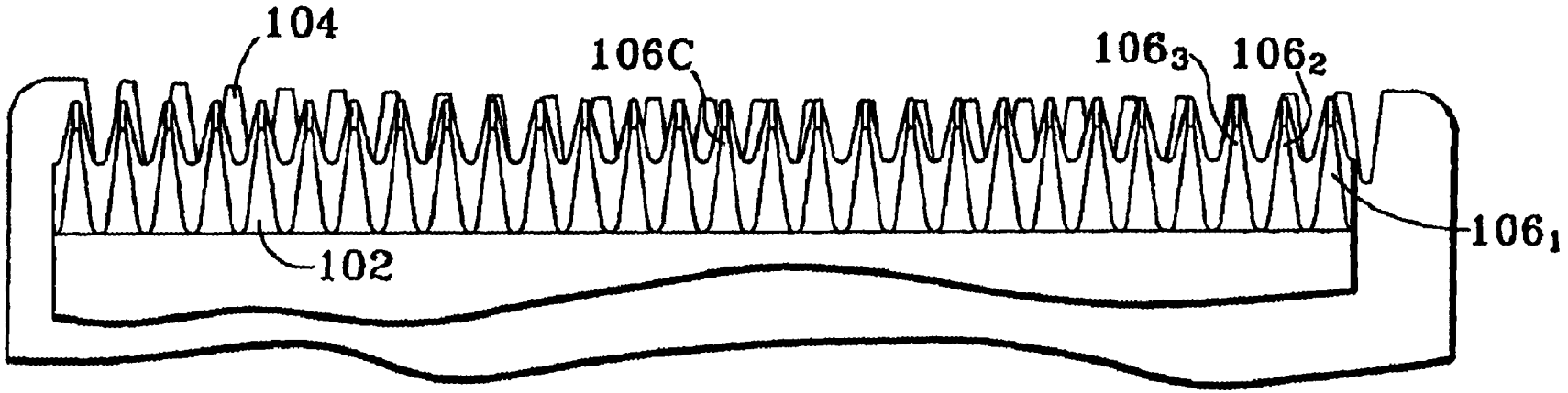
FIG. 3D shows the clipper blade assembly of FIG. 3A towards the end of a cutting stroke.

FIG. 3D shows the cutting assembly 100 towards the end of a cutting stroke. In particular, FIG. 3D shows that the teeth 102 do not extend beyond the teeth 108 at the end of the cutting stroke.

Figure 4A:
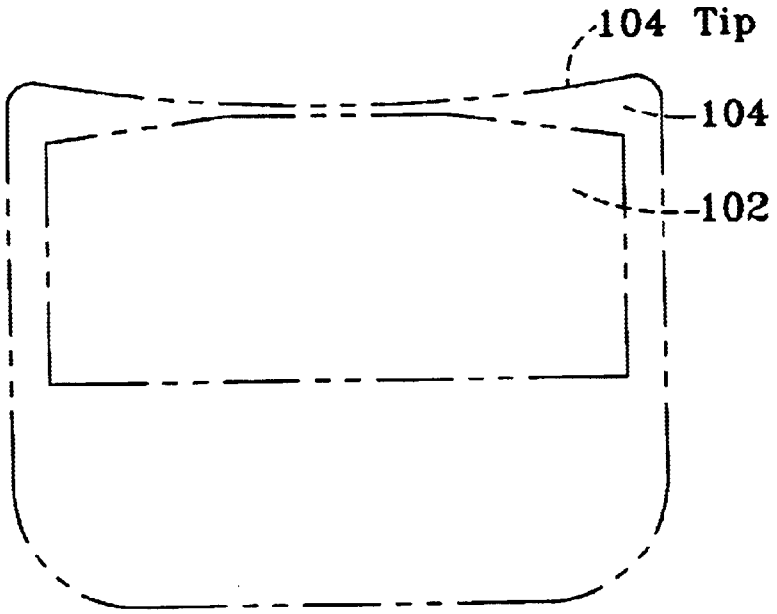
FIG. 4A is an overhead plan view of another embodiment of the present clipper blade assembly.
Figure 4B:
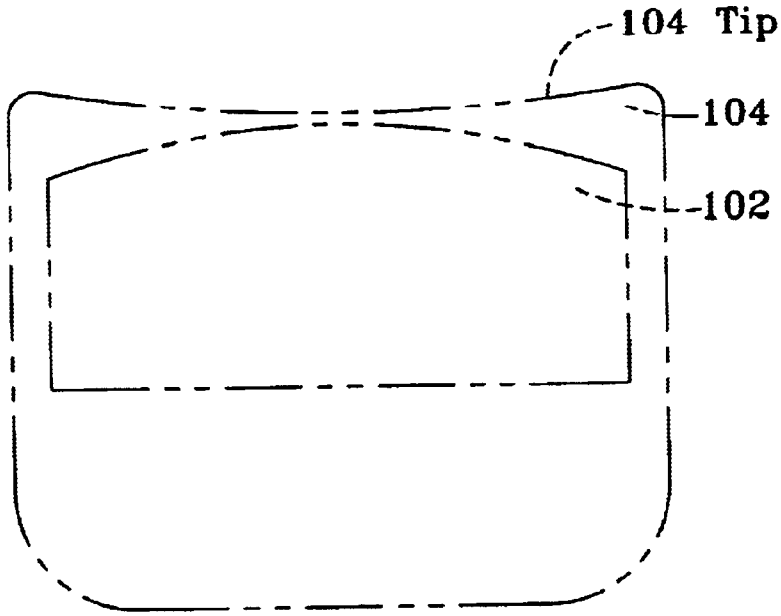
FIG. 4B is a variation on the embodiment shown in FIG. 4A.

FIGS. 4A and 4B show the overall shapes of the reciprocating cutting blade 102 and the stationary cutting blade 104 of two other embodiments of the present invention. FIG. 4A shows an embodiment in which the tips of the stationary blade 104 form an imaginary line that defines a concave curve, and the tips of the reciprocating blade 102 define an imaginary line that has straight angled portions on the ends and a straight line portion in the middle.

FIG. 4B shows an embodiment in which the tips of the stationary blade 104 define an imaginary tip line that is curved on the ends and straight in the middle. The reciprocating blade 102 in this embodiment defines and imaginary tip line with a convex curve along its entire length. It should be noted that the present invention is not limited to the embodiments depicted, but also includes combinations of the disclosed embodiments, such as the stationary blade defining an imaginary tip line created by a concave curved line and the reciprocating blade defining an imaginary tip line created by a convex line; the stationary blade defining an imaginary tip line created by straight angled line segments and the reciprocating blade defining an imaginary tip line created by convex line segments on the ends and a straight line portion in the center; etc. One important consideration to remember when determining the blade shapes of the present invention is that the distance between the tips of the reciprocating blade and the tips of the stationary blade should be increased near the ends thereof. As discussed above, such increased distances at the ends may be achieved by reducing the tip heights of the end sections of teeth of the reciprocating blade, by increasing the tip heights of the end sections of teeth of the stationary blade, or by a combination of these tip reductions of the reciprocating blade and these tip elongations of the stationary blade. In this manner, the tips of the reciprocating blade will not overlap the tips of the stationary blade, even as the reciprocating blade moves in its designated arcuate motion.

The advantages of this invention should now be apparent. Specifically, the various embodiments incorporate a unique design which enables a decrease in the overlap between the reciprocating cutting teeth and the stationary cutting teeth, thereby facilitating a closer cut than that possible with conventional cutting blade assemblies, without increasing the likelihood of cutting or nicking.

While the principles of the invention have been described above in connection with a specific apparatus and specific applications, it is to be understood that this description is made only by way of example and not as a limitation on the scope of the invention.

What is claimed is:

1. A blade assembly for an electric hair cutter with a vibrator motor, said blade assembly comprising:

a stationary blade including a plurality of stationary cutting teeth, with each of said stationary cutting teeth having a tip at a distal end thereof, and wherein said tips of said stationary cutting teeth define a first imaginary line;

a cutting blade configured for vibratory reciprocating elliptical arcuate motion relative to said stationary blade and having a plurality of reciprocating cutting teeth, with each of said reciprocating cutting teeth having a tip at a distal end thereof, and wherein said tips of said reciprocating cutting teeth define a second imaginary line; and wherein the distance between said first imaginary line and said second imaginary line is greater near both end portions thereof than a corresponding distance at a center portion between said end portions, and wherein the distance at one of said end portions is different from the distance at the other of said end portions, and further wherein said first imaginary line is a generally straight line and said second imaginary line is a line that is not generally straight along the entire length thereof.

2. The blade assembly according to claim 1, wherein said second imaginary line is a generally convexly curved line.

3. The blade assembly according to claim 2, wherein said second imaginary line includes a generally straight portion near a center thereof.

4. The blade assembly according to claim 1, wherein at least one of said first imaginary line and said second imaginary line is completely defined by three relatively straight line segments extending in different directions.

5. A blade assembly for an electric hair cutter, said blade assembly comprising:

a stationary blade including a plurality of stationary cutting teeth, with each of said stationary cutting teeth having a tip at a distal end thereof, and wherein said tips of said stationary cutting teeth define a first imaginary line;

a cutting blade configured for reciprocating arcuate motion relative to said stationary blade and having a plurality of reciprocating cutting teeth, with each of said reciprocating cutting teeth having a tip at a distal end thereof, and wherein said tips of said reciprocating cutting teeth define a second imaginary line;

wherein the distance between said first imaginary line and said second imaginary line is greater near both end portions thereof than a corresponding distance at a center portion between said end portions; and further wherein said second imaginary line is a generally straight line and said first imaginary line is a line that is generally not straight along the entire length thereof.

6. A blade assembly for an electric hair cutter, said blade assembly comprising:

a stationary blade including a plurality of stationary cutting teeth, with each of said stationary cutting teeth having a tip at a distal end thereof, and wherein said tips of said stationary cutting teeth define a first imaginary line; and a cutting blade configured for reciprocating arcuate motion relative to said stationary blade and having a plurality of reciprocating cutting teeth, with each of said reciprocating cutting teeth having a tip at a distal end thereof, and wherein said tips of said reciprocating cutting teeth define a second imaginary line;

wherein the distance between said first imaginary line and said second imaginary line is greater near both end portions thereof than a corresponding distance at a center portion between said end portions; and further wherein said first imaginary line is a generally concavely curved line.

7. The blade assembly according to claim 6, wherein said first imaginary line includes a generally straight portion near the center thereof.

8. A blade assembly for an electric hair cutter, said blade assembly comprising:

a stationary blade including a plurality of stationary cutting teeth, with each of said stationary cutting teeth having a tip at a distal end thereof, and wherein said tips of said stationary cutting teeth define a first imaginary line; and a cutting blade configured for reciprocating arcuate motion relative to said stationary blade and having a plurality of reciprocating cutting teeth, with each of said reciprocating cutting teeth having a tip at a distal end thereof, and wherein said tips of said reciprocating cutting teeth define a second imaginary line;

wherein the distance between said first imaginary line and said second imaginary line is greater near both end portions thereof than a corresponding distance at a center portion between said end portions; and further wherein said first imaginary line is a generally concavely curved line and said second imaginary line is a generally convexly curved line.

9. The blade assembly according to claim 8, wherein said first imaginary line includes a generally straight portion near a center thereof.

10. The blade assembly according to claim 8, wherein said second imaginary line includes a generally straight portion near a center thereof.

11. The blade assembly according to claim 8, wherein both said first imaginary line and said second imaginary line include generally straight portions near respective center portions thereof.

12. An electric hair clipper comprising:

a housing;

a vibrator motor provided in said housing;

a stationary blade including a plurality of stationary cutting teeth, with each of said stationary cutting teeth having a tip at a distal end thereof, and wherein said tips of said stationary cutting teeth define a first imaginary line;

a cutting blade configured to be driven by said vibrator motor with vibratory reciprocating arcuate elliptical motion relative to said stationary blade and having a plurality of reciprocating cutting teeth, with each of said reciprocating cutting teeth having a tip at a distal end thereof, and wherein said tips of said reciprocating cutting teeth define a second imaginary line; and a vibrating arm for transferring vibratory motion from said vibrator motor to said cutting blade, said vibrating arm being connected to said housing near a rear portion thereof, while said stationary blade and said cutting blade are located near a front portion of said housing, wherein the distance between said first imaginary line and said second imaginary line is greater near both end portions thereof than a corresponding distance at a center portion between said end portions, and where the distance at one of said end portions is different from the distance at the other of said end portions, and further wherein said first imaginary line is a generally straight line and said second imaginary line is a line that is not generally straight along the entire length thereof.

13. The electric hair clipper according to claim 12, wherein said second imaginary line includes a relatively straight portion near a center thereof.

14. The electric hair clipper according to claim 12, wherein said vibrator motor is located between the connection point of said vibrating arm with said housing and a blade assembly defined by said stationary blade and said cutting blade.

15. An electric hair clipper comprising:

a housing;

a motor provided in said housing;

a stationary blade including a plurality of stationary cutting teeth, with each of said stationary cutting teeth having a tip at a distal end thereof, and wherein said tips of said stationary cutting teeth define a first imaginary line;

a cutting blade configured for reciprocating arcuate motion relative to said stationary blade and having a plurality of reciprocating cutting teeth, with each of said reciprocating cutting teeth having a tip at a distal end thereof, and wherein said tips of said reciprocating cutting teeth define a second imaginary line; and wherein the distance between said first imaginary line and said second imaginary line is greater near both end portions thereof than a corresponding distance at a center portion between said end portions; and further wherein said first imaginary line is completely defined by three relatively straight line segments extending in different directions.

16. An electric hair clipper comprising:

a housing;

a motor provided in said housing;

a stationary blade including a plurality of stationary cutting teeth, with each of said stationary cutting teeth having a tip at a distal end thereof, and wherein said tips of said stationary cutting teeth define a first imaginary line; and a cutting blade configured for reciprocating arcuate motion relative to said stationary blade and having a plurality of reciprocating cutting teeth, with each of said reciprocating cutting teeth having a tip at a distal end thereof, and wherein said tips of said reciprocating cutting teeth define a second imaginary line;

wherein the distance between said first imaginary line and said second imaginary line is greater near both end portions thereof than a corresponding distance at a center portion between said end portions; and further wherein said second imaginary line is completely defined by three relatively straight line segments extending in different directions.

* * * * *